US006002646A

United States Patent [19]

Reid et al.

[11] Patent Number: 6,002,646

[45] Date of Patent: Dec. 14, 1999

[54] PORTABLE OPTICAL RANGE TRACKING ARRAY

[75] Inventors: Robert J. Reid, Tiverton; Russel A. Racette, III, Newport; Antonio L. Deus, III, Westerly, all of R.I.

[73] Assignee: The United States of America as represented by the Secretary of the Navy, Washington, D.C.

[21] Appl. No.: 08/884,493

[22] Filed: Jun. 27, 1997

[51] Int. Cl.[6] ..... H04R 1/44

[52] U.S. Cl. ..... 367/149

[58] Field of Search ..... 367/149, 153, 367/154, 173, 188, 141; 385/7, 12, 13; 250/227.14, 227.16; 356/345

[56] References Cited

U.S. PATENT DOCUMENTS

| | | | |
|---|---|---|---|
| 4,115,753 | 9/1978 | Shajenko | 367/149 |
| 4,311,391 | 1/1982 | Gilmour | 367/149 |
| 4,313,185 | 1/1982 | Chovan | 367/149 |
| 4,320,475 | 3/1982 | Leclerc et al. | 367/149 |
| 4,422,167 | 12/1983 | Shajenko | 367/149 |
| 4,649,529 | 3/1987 | Avicola | 367/149 |
| 4,688,200 | 8/1987 | Poorman et al. | 367/149 |
| 4,751,690 | 6/1988 | Kruger | 367/149 |
| 4,799,202 | 1/1989 | Assard | 367/149 |
| 4,882,716 | 11/1989 | Lefevre et al. | 367/149 |
| 4,893,930 | 1/1990 | Garrett et al. | 367/149 |
| 5,051,965 | 9/1991 | Poorman | 367/149 |
| 5,155,548 | 10/1992 | Danver et al. | 367/149 |
| 5,155,707 | 10/1992 | Fisher | 367/149 |

*Primary Examiner*—Daniel T. Pihulic
*Attorney, Agent, or Firm*—Michael J. McGowan; Robert W. Gauthier; Prithvi C. Lall

[57] ABSTRACT

A portable tracking array to be used in a system for determining the track and/or the range of a target vehicle. The array includes a fiber optic hydrophone for acquiring acoustic signals from the target vehicle. The fiber optic hydrophone is encapsulated within a plastic material such as polyurethane. The array further includes a fiber optic cable for transmitting signals to and for receiving signals from the fiber optic hydrophone, which fiber optic cable has an end encapsulated within a termination coupling, and a length of perforated material extending between the terminal coupling and the plastic material encapsulating the fiber optic hydrophone to allow water entry and to substantially eliminate air cavities which interfere with acoustic performance.

21 Claims, 3 Drawing Sheets

PORTABLE OPTICAL RANGE TRACKING ARRAY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an optical range tracking array for receiving acoustic tracking signals and to a system for tracking vehicles using said optical range tracking array.

(2) Description of Prior Art

Optical acoustic sensors are known in the art and have been used in a number of different environments for a number of different purposes. U.S. Pat. Nos. 4,313,185 to Chovan; 4,320,475 to Leclerc et al.; 4,422,167 to Shajenko; 4,751,690 to Krueger; 4,799,202 to Assard; 4,882,716 to Lefevre et al.; 4,893,930 to Garrett et al.; 5,155,548 to Danver et al.; 5,155,707 to Fisher; and 4,688,200 to Poorman et al. illustrate various types of optical acoustic sensors known in the art and their uses.

The Chovan patent relates to an acoustic vibration sensor employing a pair of single mode optical fibers, optically coupled by a path whose length is varied by the acoustic vibrations. The sensor further includes a partially reflecting discontinuity at the sensitive end of each fiber. Optical signals of one frequency are supplied to one fiber, and of another frequency to the other fiber. Optical signals of the same difference frequency emerge from the dry end of each fiber. When these two emergent signals are photodetected, and the phase or frequency difference is obtained, the acoustic vibration is sensed.

The Leclerc et al. patent relates to a monomodal optical fiber hydrophone operating by the elastooptical effect. The hydrophone has an interferometer structure incorporating a measuring arm in which is provided a very long monomodal optical fiber immersed in the interaction medium in which is propagated the acoustic wave. A phase displacement is induced on the optical wave by the elastooptical effect and said wave is propagated in the fiber by the acoustic wave which creates an acoustic pressure field in the medium. A reference arm establishes a reference optical path and the phase displacement: linked with the acoustic wave is detected by interferometry between the two optical waves emerging from the two arms.

The Shajenko patent relates to a wide area acousto-optic hydrophone which uses signal and reference laser beams together with interferometric methods for detecting underwater acoustic signals. The signal beam is distributed across the wide sensing area of the hydrophone using beam folding techniques while being directly transmitted through a sensing chamber filled with an optically transparent bulk material, the refractive index of which varies with the incident acoustic pressure thereby modulating the signal beam. Concurrently, a reference beam of equal length and folded in an identical pattern is directly passed through an adjacent chamber filled with the same bulk material. A microhole joins the two chambers to expose the reference beam to the same static pressure and temperature fluctuations as the signal beam, thus serving as a low pass filter. The modulated signal beam and the unmodulated reference beam are then combined and superimposed on the surface of a photodetector, the output of which is proportional to the phase shifts produced by the incident acoustic signal.

The Krueger patent relates to a fiber optic interferometric hydrophone based on the change in optic path length of optic fibers bonded to both sides of a bending beam which acts as an acoustically sensitive diaphragm. The bending beam is segmented into an even number of segments, acoustic windows are arranged such that opposite sides of the beam see the acoustic field in adjacent segments, and the optic fibers cross from one side of the beam to the other to maintain the phase of strain signal for the two fibers, one on each side, along the full length of the bending beam.

The Assard patent relates to a cylindrical interferometric hydrophone having an axial hollow free-flooded volume which includes an outer fiber wrap for a sensor leg and an inner fiber wrap for a reference leg. Both inner and outer fiber wraps are wound on elastomers and exposed to a fluid medium for sensing acoustic signals.

The Lefevre et al patent relates to an optic fiber hydrophone which comprises a wide spectrum optical source, a super-luminescent diode associated with an optical fiber assembly comprising chiefly a side-hole optic fiber, subjected to the field of pressure, forming a sensor, transmitting the optic radiation in the slow and fast modes respectively, and a second fiber, not subjected to the field of pressure, the neutral axes of which are oriented with respect to the neutral axis of the first fiber so that the wave transmitted in slow mode in one fiber is transmitted in fast mode in the other fiber. The two fibers may be connected by a polarization maintaining fiber, which enables the creation of interferences, in the event that the sensor is offset with respect to the source.

The Garrett et al. patent relates to a multiple axis, fiber optic interferometric seismic sensor. The mechanical vibration transducer includes a seismic mass supported by a plurality of cylindrical silicone rubber mandrels. Each mandrel is wound with a length of optical fiber which has a reflective end and a transmissive end. A case surrounds the assemblage and is connected to the supports. When the case is displaced, the supports change diameter in response to the relative motion between the seismic mass and the case. This change in diameter is translated to a change in length of the optical fiber. By using the fibers as arms of a Michelson interferometer, a sensitive instrument responsive to displacing vibrations is obtained. This instrument is energized entirely by light transmitted through optical fiber waveguides and whose information is transmitted to the observer using only light waves in optical fibers.

The Danver et al. patent relates to a mismatched path length fiber optic interferometer which is optically coupled to an optical fiber and configured to form an omnidirectional acoustic sensor. A second mismatched path length fiber optic interferometer is optically coupled to the optical fiber and configured as a first gradient sensor. A second fiber optic gradient sensor is also optically coupled to the optical fiber. A detector optically coupled to the omnidirectional acoustic sensor and to the gradient sensors converts optical signals output therefrom to electrical signals indicative of the magnitude and direction of changes in an acoustic field. The omnidirectional acoustic sensor may include a length of optical fiber wrapped around the housing while the gradient sensors are mounted inside the housing. The housing has a volume that is adjustable for controlling the buoyancy thereof. Each gradient sensor preferably comprises a pair of mandrels formed to enclose chambers. Optical fiber coils are formed on the mandrels. Both the chambers are filled with a fluid and placed in fluid communication through a tube that defines a sensing axis between the mandrels such that acceleration of the housing along the sensing axis causes a fluid pressure differential on the first and second optical fiber coils.

The Fisher patent relates to an omnidirectional hydrophone having a pair of fiber optic windings wrapped around a resilient ball to form a spherical acoustic sensor. The fiber-optic pair has a first fiber which has a bonded jacket and a second fiber which has an unbonded jacket. The fiber with the bonded jacket is sensitive to both vibrations of the mounting structure and impinging acoustic signals. The fiber with the unbonded jacket is sensitive to vibrations but insulated from impinging acoustic signals. The hydrophone detects acoustic signals by detecting the phase difference between the two fibers.

The Poorman et al. patent relates to an optical system for detecting acoustic wave energy in a fluid medium in which coherent radiation from a laser is coupled to unequal length optical paths exposed to modulation by the acoustic energy weave generated by the sound source. The reflected beams from the paths are crosscoupled to generate interference fringes in two output beams out of phase with each other. The fringes in one output beam are counted in an up/down counter to determine the magnitude of the pressure as a function of time. The direction of the pressure change is determined by examination of the phase relationship between the fringes in the output beams. Peaks and valleys in the pressure are detected as phase reversals between the fringes in the output beams by detecting the beginning and end of a fringe in one beam without detecting the beginning or end of a fringe in the other beam therebetween. The direction of counting of the counter is reversed upon detection of a peak or valley in the modulating pressure to maintain the count as an accurate representation of the magnitude of the pressure.

U.S. Pat. No. 4,115,753 to Shajenko discloses a fiber-optic acoustic array using optic hydrophones in which sound waves are sensed and displayed as modulated light signals. The light signals so generated are transmitted along the fiber-optic bundles.

U.S. Pat. No. 4,311,391 to Gilmour illustrates a passive. fiber optic sonar system wherein first and second optical fibers are wound on a common mandrel and provided with a light energy beams. An acoustic signal differentially varies the index of refraction of the optical fibers to result in an interference pattern dependent upon the frequency of the received acoustic signal or signals.

U.S. Pat. No. 4,649,529 to Avicola relates to a multichannel fiber optic sensor system including two or more sensors formed on an optical fiber and a phase sensitive detector. Each sensor includes two reflectors separated by a section of the fiber. Each reflector may be activated so that when an interrogating light signal propagates in a first direction past the activated reflector, a portion of the interrogating light signal will be reflected back into a direction opposite the first direction. Each reflector may also be deactivated so that the interrogating signal may propagate unhindered past the deactivated reflector. Variations in the optical path length between the reflectors of a sensor, due to changes in an external parameter of interest, will cause phase modulations that are extracted in the phase sensitive detector by homodyne or heterodyne techniques.

U.S. Pat. No. 5,051,965 to Poorman relates to an acousto-optical seismic sensor array including a distributed set of optical fiber sensing coils. A light pulse is launched through the sensing coils in serial order. The light pulse is cumulatively data-modulated by the respective sensing coils and is returned as a time division multiplexed pulse train. The pulse train is split into a first pulse train and a retarded second pulse train. The retardation time equals the travel-time delay of a light pulse between sensors. The retarded pulse train is compared with the first pulse train to determine the phase shift therebetween for consecutive pulses. The phase shift is an analog of the quantity being sensed.

In past designs, portable shallow water tracking sensor arrays have consisted of electrical, mechanical and/or optical components. The electronics perform the complex function of interfacing to an acoustic sensor and transmitting information to the processing system. The fact that electronics were required, complicated the design in the following technical areas. By forcing water tight integrity of the electronic components, the mechanical housing had to be designed and fabricated such that no sea water intrusion occurs at the hydrostatic pressure where the system will be used. Further, the housing must remain dry at all times.

With the advent of optical long haul communications technology into undersea range tracking systems, the in-water design is further complicated. The hydrophone sensor node interconnect and trunk cable designs are also complex because of the joining and terminating of the electrical, mechanical and optical properties required in the cable. Termination of the cable is a perplexing task involving several intricate steps in order to keep the sea-water from intruding into the system. All these processes increase the overall system cost, the labor and skill required to perform the assembly processes due to the complex designs.

There are times when portable shallow water tracking sensor arrays are to be installed in harsh ocean environments due to testing requirements. The harsh shallow water ocean environments include areas of rough bottom types such as coral and where local bottom fishing operations occur. In such environments loss of part of the system is a real possibility during the course of the installation period. It would be a big advantage to develop a system that was as inexpensive as possible so that the financial loss of equipment would be minimized.

SUMMARY OF THE INVENTION

Accordingly, it is an object of the present invention to provide a portable tracking sensor array that is inexpensive to produce.

It is a further object of the present invention to provide a portable tracking sensor array as above that has no active electronic components.

It is still a further object of the present invention to provide a portable tracking sensor array that can be used in a high risk deployment environment.

It is yet another object of the present invention to provide a portable tracking sensor array that may be used in a three-dimensional tracking system.

The foregoing objects are attained by the portable optical tracking sensor array of the present invention.

A portable optical tracking sensor array in accordance with the present invention comprises means for acquiring acoustic signals, which means preferably comprises a fiber optic hydrophone. The acoustic signal acquiring means is encapsulated with a plastic material such as polyurethane. The array further includes means for transmitting signals to and for receiving signals from the acoustic signal acquisition means, which signal transmitting means has an end encapsulated within a terminal coupling. Still further, the array includes a length of perforated material extending between the terminal coupling and the encapsulating plastic material to allow water entry and to substantially eliminate air cavities which interfere with acoustic performance.

As previously discussed, the portable optical tracking sensor array forms part of a tracking system. The overall system includes means for processing the acoustic signals to generate information about the track and/or range of a target vehicle under observation and an optical fiber cable linking the processing means and the sensor array. In most tracking systems in accordance with the present invention, a plurality of sensor arrays, connected by lengths of optical fiber cable, will be deployed and used to provide acoustic signals to the signal processing means.

BRIEF DESCRIPTION OF THE DRAWINGS

These and other details of the present invention, as well as other objects and advantages attendant thereto, will be described in the following detailed description and the accompanying drawings, in which like reference numerals depict like elements and wherein.

DETAILED DESCRIPTION OF THE PREFERRED EMBODIMENT(S)

Figure 1:
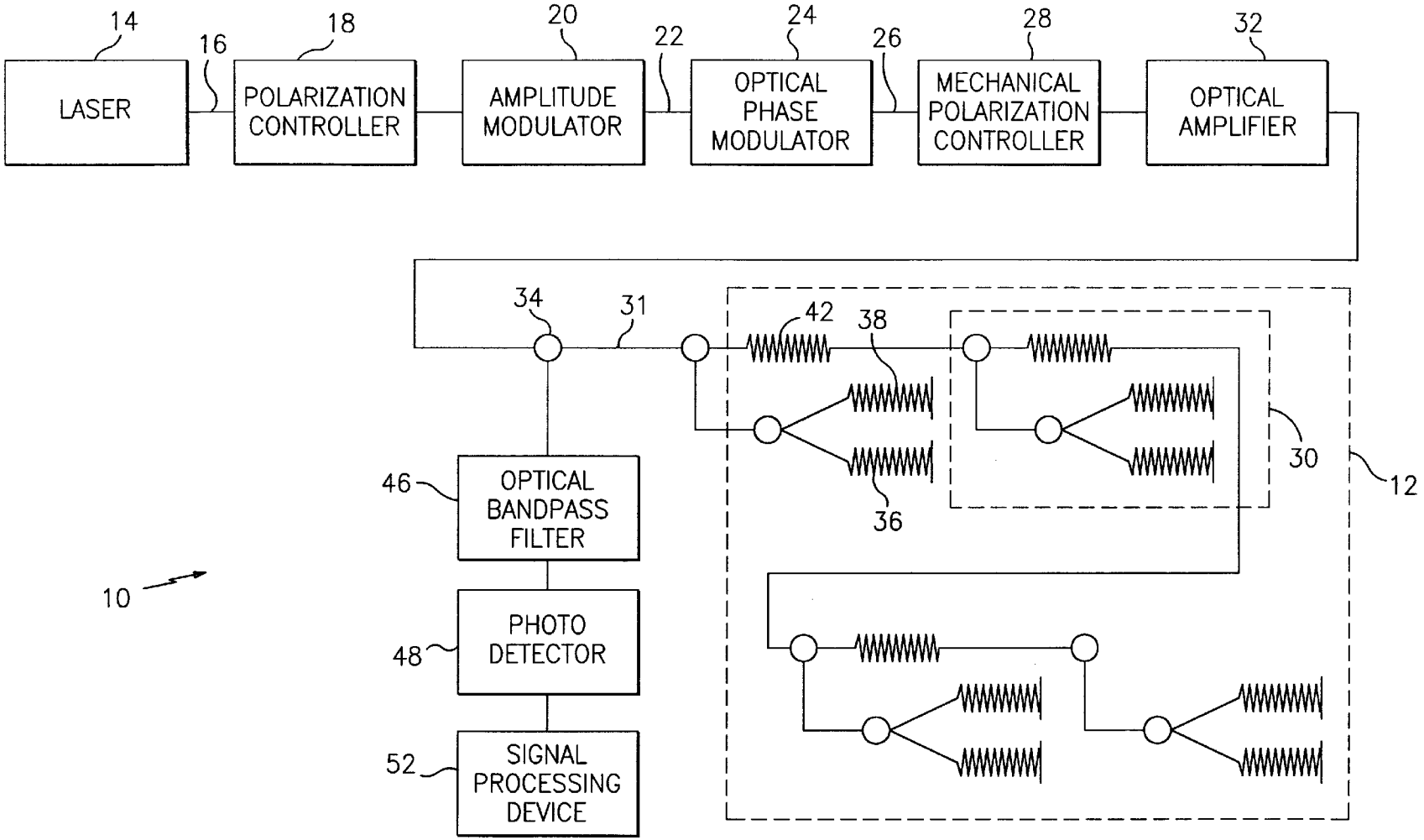
FIG. 1 is a schematic representation of a tracking system using the portable optical tracking sensor array of the present invention.

Referring now to the drawings, FIG. 1 is a schematic representation of a system 10 employing the portable optical tracking sensor array 12 of the present invention. As shown in FIG. 1, a continuous wave, high coherence laser 14 is used to generate a continuous light wave. The light generated by the laser 14 enters an optical fiber 16 and is inputted into a mechanical polarization controller 18 attached to an amplitude modulator 20. The mechanical polarization controller 18 adjusts the state of polarization into the modulator 20 to achieve maximum extinction from the modulator. The amplitude modulator 20 modulates the continuous light wave into a series of light pulses.

The optical fiber 22 at the output of the amplitude modulator 20 is attached to an optical phase modulator 24. The optical phase modulator 24 is used to impart a phase generated carrier. The optical fiber 26 at the output of the phase modulator 24 is attached to a mechanical polarization controller 28 which adjusts the state of polarization to maximize the fringe visibility of the interferometric sensors 30.

An optical amplifier 32 is provided to amplify the light from the laser 14. The amplified light pulses are transmitted to the sensor(s) 30 in the array 12 via an optical fiber 31 embedded within an optical fiber cable 44. The optical fiber 31 also serves as the fiber for return signals from the array sensor(s) 30, which are preferably reflective interferometric sensors. If sensors which are non-reflective are used, then the optical fiber cable 44 to the array sensor(s) 30 requires a minimum of two optical fibers.

As shown in FIG. 1, the cable 44 with the optical fiber 31 embedded therein has a number of couplers 34 provided along its length. The couplers 34 act as passive optical splitters for splitting the light pulses into two signals as needed. Further, the optical fiber 31 has a number of wound portions 42 between sensor(s) 30. The wound portions 42 are used to cause delays in the transmission of signals along the optical fiber 31 in both directions.

As previously mentioned, return signals from the sensor(s) 30 travel along optical fiber 31. The return signals are fed to an optical bandpass filter 46 when an optical amplifier is used. This is necessary to filter the amplifier amplified spontaneous emission. The signals are then fed to a photodetector 48 where they are converted to an electronic signal. The electronic signals are then fed to a signal processing system 52 for processing the signals using known mathematical techniques to ascertain the track and/or the range of the target vehicle. The signal processing system 52 does not form part of the present invention and therefore is not described in detail. Any suitable signal processing system known in the art may be used. It is contemplated that the optical bandpass filter 46, the photodetector 48, and the signal processing system 52 for determining the track and/or range of the target vehicle, as well as the laser 14, the mechanical polarization controllers 18 and 28, the amplitude modulator 20, the phase modulator 24, and the optical amplifier 32, will be located at either a land station or onboard an observer vessel.

Figure 2:
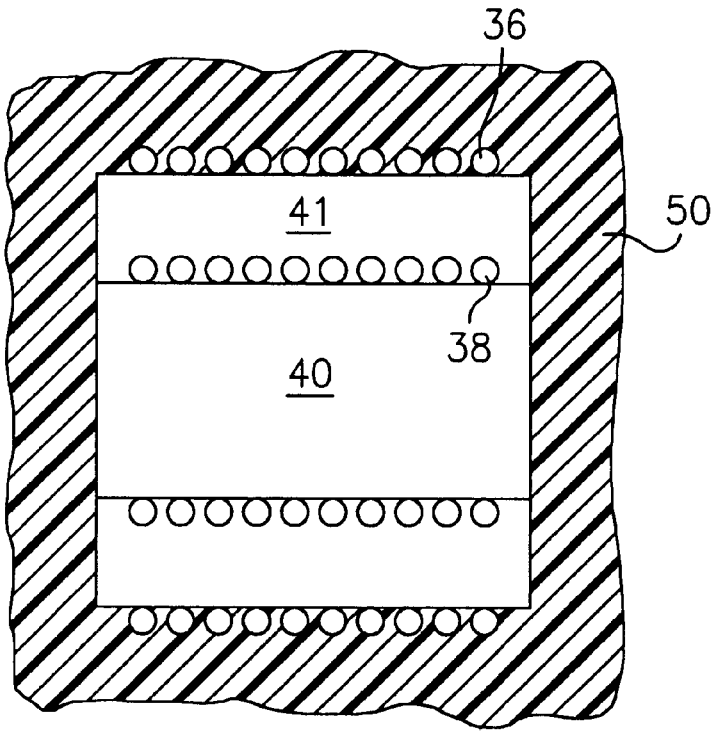
FIG. 2 is a schematic representation of an encapsulated fiber optic hydrophone used in the sensor array of the present invention.

The array 12 may contain one or more acoustic sensors 30. Preferably, the sensors 30 are preferably fiber optic interferometric hydrophones that consist of mandrel-wound optical fibers. They can be of any interferometer design such as Mach-Zehnder, Fabry-Perot, and Micheleson. FIG. 2 illustrates one hydrophone configuration which can be used in the system of the present invention.

As shown in FIG. 2, the hydrophone sensor 30 includes a sensing fiber 36 and a reference fiber 38. The reference fiber 38 is wound about an interior mandrel 40, which may be formed from aluminum, and is effectively motionless. The sensing fiber 36 is wrapped around a concentric outer mandrel 41 made from a material which flexes under the effects of acoustic pressure. As a result of the flexing of the mandrel 41, the sensing fiber 36 moves and thereby modulates the light in response to the acoustic pressure acting on the mandrel 41. Both fibers 36 and 38 and the mandrels about which they are wound are encapsulated or potted within a plastic material 50 such as polyurethane. Preferably, a suitable length mismatch in fibers 36 and 38 is chosen to produce a phase generated carrier. Additionally, both fibers 36 and 38 are preferably provided with a reflective end so that the optical signals produced by the fibers can be returned along optical fiber 31 to be processed by the signal processing system 52. The difference between the signal generated by the reference fiber and the signal generated by the sensing fiber represents the acoustic pressure.

Figure 3:
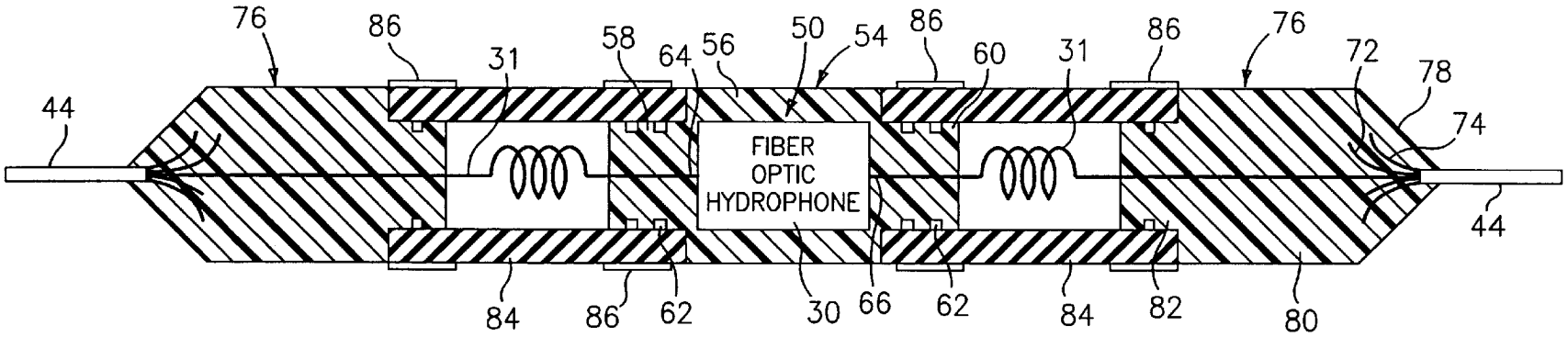
FIG. 3 is a sectional view of a sensor package used in the system of the present invention.

As shown in FIG. 1, the array 12 includes a number of hydrophone sensors 30 arranged in series. The sensors 30 are preferably connected to adjacent sensors by a single optical fiber 31 embedded within a length of optical fiber cable 44. FIG. 3 illustrates the configuration of the package used to house each sensor 30 and to mechanically connect each sensor to the optical fiber 31 and the cable 44.

Referring now to FIG. 3, the sensor package 54 has a central portion which comprises the fiber optic hydrophone sensor 30 encapsulated within the polyurethane material 50. The polyurethane material 50 surrounding the sensor 30 is preferably molded into a cylindrical core portion 56 and cylindrical end portions 58 and 60. The cylindrical core portion 56 has a desired outer dimension. The molded end portions 58 and 60 each have one or more corrugations 62 whose purpose will be explained hereinafter. Additionally, the end portions 58 and 60 have ail outer dimension less than the outer dimension of the cylindrical core portion 56. Optical fibers 64 and 66 protrude from the opposed ends of the sensor 30 and pass through openings (not shown) in the end portions 58 and 60. With the exception of the last sensor 30 in the array, the optical fibers 64 and 66 are each connected to a length of optical fiber 31.

Figure 4:
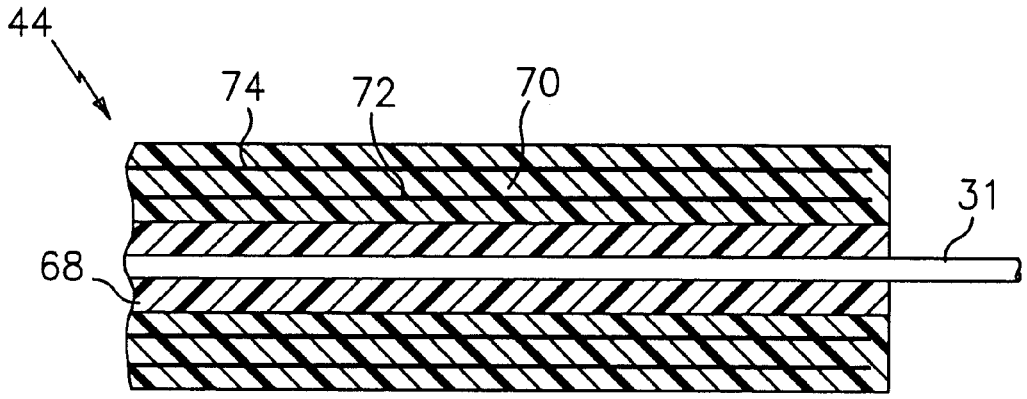
FIG. 4 is a sectional view of an optical fiber cable used in the system of the present invention.

Referring now to FIG. 4, each length of optical fiber cable 44 has a length of optical fiber 31 extending therethrough. The optical fiber 31 is surrounded by a coextensive layer of Fiberglass reinforcing material 68. The optical fiber 31 preferably comprises a single mode, dispersion shifted optical fiber. A layer 70 of abrasion resistant material, such as a high density polyethylene material, surrounds the layer of Fiberglass reinforcing material 68. A suitable high density polyethylene material for this application is sold under the trade name HYTREL. Two layers 72 and 74 of galvanized implowed steel wires are embedded within the abrasion resistant layer 70. The inner layer 72 may comprise 14 wires with a right hand lay, while the outer layer 74 comprises 9 outer wires in a low torque spaced construction. It has been found that a cable of this construction has a breaking strength of 800 pounds and a nominal weight in air of 20 pounds per 1000 feet.

Referring, again, to FIG. 3, respective lengths of the optical fiber cable 44 are connected to the sensor package 54 by termination couplings 76. Each termination coupling 76 preferably comprises a plastic material, such as polyvinylchloride, molded about the end portion of a length of the optical fiber cable 44 with the two layers 72 and 74 of galvanized implowed steel wires extending into the termination coupling. As shown in FIG. 3, termination coupling 76 is preferably molded to have a conically shaped outer end portion 78, a cylindrically shaped central portion 80 and a corrugated interior end portion 82. Each optical fiber 31 to be joined to one of the fibers 64 and 66 passes through its respective termination coupling 76 and protrudes from the inner end portion 82.

The termination couplings 76 are connected to the polyurethane material 50 encapsulating the fiber optic hydrophone 30 by lengths of hose 84. Each length of hose 84 preferably has an inner diameter which corresponds to the diameter of the corrugated termination coupling inner end portions 82 and the corrugated end portions 58 and 60. The outer dimension of the hose 84 should substantially correspond to the outer dimension of the cylindrical core portion 56 and to the outer dimension of the termination coupling cylindrically shaped central portion 80. Whippings or strings 86 are provided to connect the length of hoses 84 to the corrugated termination coupling inner end portions 82 and to the corrugated end portions 58 and 60. The whippings 86 are placed around the hose 84 and tightened to make a good connection.

The hoses 84 may be formed out of any suitable material known in the art. The hoses 84 are perforated however to allow water entry and to substantially eliminate any air cavities which interfere with acoustic performance.

The portion of each optical fibers 31 extending through a length of hose is preferably looped to facilitate disassembly of the package 54, if needed for maintenance, without having to disconnect the connections between the fibers 31 and the respective ones of fibers 64 and 66.

The sensor package and the armored optical fiber cable enable the system of the present invention to be used in high risk deployment environments. A high risk location is a site where bottom fishing or rough bottom conditions exist and the loss of an in-water system is a possibility.

The sensor package and the armored optical fiber cable also enable the system to deployed without the assistance of large expensive machinery. The system can be deployed off of a small reel winder or directly by hand. For example, the system can be deployed off small boats of less than 50 feet.

Still further, the system of the present invention is relatively inexpensive. The sensor package can be developed from commercial off the shelf components. Further, none of the procurement items require long lead time. The time of assembly is limited by the cure time for the particular material used to form the termination couplings.

The system also has the advantage that the hydrophones can all be assembled prior to deployment. At the deployment site, the hydrophone can be packaged for a given number of sensors to be configured. The absence of electrical components eliminateS the need for watertight components. This greatly reduces and simplifies the design.

It is apparent that there has been provided in accordance with this invention a portable optical range tracking array which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A portable tracking array comprising:

means for acquiring an acoustic signal, said acoustic signal acquisition means being encapsulated within a plastic material;

means for transmitting signals to and for receiving signals from said acoustic signal acquisition means, said signal transmitting means having an end encapsulated within a terminal coupling; and a length of perforated material extending between said terminal coupling and said encapsulating plastic material to allow water entry and to substantially eliminate air cavities which interfere with acoustic performance.

2. The portable tracking array of claim 1 wherein:

said plastic material encapsulating said acoustic signal acquisition means has a first corrugated end portion;

said terminal coupling has an inner corrugated end portion; and said length of perforated material is coupled to said first corrugated end portion and said inner corrugated end portion by means extending about the outer periphery of said length of perforated material for tightening said perforated material so that it engages the corrugations in said end portions.

3. The portable tracking array of claim 1 wherein said plastic material comprises a polyurethane material and said terminal coupling is formed from molded polyvinylchloride.

4. The portable tracking array of claim 1 wherein said perforated material comprises a perforated hose.

5. The portable tracking array of claim 1 wherein:

said acoustic signal acquisition means comprises a fiber optic hydrophone; and said signal transmitting means comprises a single optical fiber cable having an optical fiber embedded therein.

6. The portable tracking array of claim 5 wherein said optical fiber comprises a single mode optical fiber.

7. The portable tracking array of claim 5 wherein said cable further comprises a layer of reinforcing material surrounding said optical fiber and a layer of abrasion resistant material surrounding said layer of reinforcing material.

8. The portable tracking array of claim 7 wherein said reinforcing material is a Fiberglass reinforcing material and said abrasion resistant material comprises a high density polyethylene material.

9. The portable tracking array of claim 7 wherein said cable further comprises at least one layer of wires embedded within said layer of abrasion resistant material.

10. The portable tracking array of claim 7 wherein said acoustic signal acquisition means comprises a reflective interferometric fiber optic sensor.

11. The portable tracking array of claim 10 wherein said sensor has a motionless reference fiber and a sensing fiber, said sensing fiber moving in response to acoustic pressure.

12. The portable tracking array of claim 11 wherein both said reference fiber and said sensing fiber are wrapped about a mandrel.

13. A portable tracking system comprising:

at least one sensor package for sensing acoustic signals and for generating output signals representative of said sensed acoustic signals, each said sensor package having a first cable termination coupling at one end and a second cable termination coupling at a second end, each said sensor package further having a fiber optic hydrophone encapsulated within a plastic material and lengths of hose extending between said encapsulated fiber optic hydrophone and each of said cable termination couplings;

means for processing said output signals to determine at least one of the track and the range of a target vehicle; and an optical fiber cable linking said processing means and said at least one sensor package, said optical fiber cable containing an optical fiber, said fiber cable being coupled to said first cable termination coupling and wherein said optical fiber protrudes from an end of said optical fiber cable and passes through said first cable termination coupling.

14. The portable tracking system of claim 13 wherein each length of hose is perforated to allow water entry and to substantially eliminate air cavities which interfere with acoustic performance.

15. The portable tracking system of claim 13 further comprising a first sensor optical fiber protruding from one end of said encapsulated fiber optic hydrophone, wherein said first sensor optical fiber is connected to said optical fiber protruding frog said optical fiber cable to thereby allow light to flow to said fiber optic hydrophone and allow reflected light to travel back along said optical fiber cable to said signal processing means.

16. The portable tracking system of claim 15 further comprising:

a second sensor optical fiber protruding from a second end of said encapsulated fiber optic hydrophone; and a second length of optical fiber cable, said second length of optical fiber cable being coupled to said second cable termination coupling, said second length of optical fiber cable having a second optical fiber protruding therefrom, said second optical fiber being coupled to said second sensor optical fiber.

17. The portable tracking system of claim 13 further comprising a plurality of said sensor packages, each of said sensor packages being serially connected lengths of optical fiber cable.

18. The portable tracking system of claim 13 wherein each fiber optic hydrophone has a sensing fiber and a reference fiber, said sensing fiber being movable so as to modulate light as a result of acoustic pressure being sensed.

19. The portable tracking system of claim 13 further comprising:

means for generating a continuous wave light beam;

means for modulating the continuous wave light beam into light pulses; and means for amplifying said light pulses and for propagating them through said optical fiber in said optical fiber cable.

20. The portable tracking system of claim 19 wherein:

said light beam generating means comprises a continuous wave, high coherence laser; and said modulating means comprises an optical amplitude modulator for modulating the continuous light wave into pulses, a first mechanical polarization controller connected to an input of said amplitude modulator for receiving said light beam from said laser and for adjusting the state of polarization into said optical amplitude modulator so as to achieve maximum extinction from the amplitude modulator, an optical phase modulator for imparting a phase generated carrier connected to said optical amplitude modulator, and a second mechanical polarization controller for adjusting the state of polarization to maximize the fringe visibility of the fiber optic hydrophone.

21. The portable tracking system of claim 13 wherein said signal processing means comprises:

means for filtering the output signals received from each said sensor package;

means for converting said output signals into electronic signals; and means for processing said electronic signals to determine at least one of the track and the range of the target vehicle.

* * * * *